US008740613B1

(12) United States Patent
Friend

(10) Patent No.: US 8,740,613 B1
(45) Date of Patent: Jun. 3, 2014

(54) PURGE AIR CONTROL FOR A REGENERATIVE THERMAL OXIDIZER

(75) Inventor: Russell P. Friend, Alliance, OH (US)

(73) Assignee: Russell P. Friend, Alliance, OH (US)

( * ) Notice: Subject to any disclaimer, the term of this patent is extended or adjusted under 35 U.S.C. 154(b) by 966 days.

(21) Appl. No.: 12/762,531

(22) Filed: Apr. 19, 2010

Related U.S. Application Data

(60) Provisional application No. 61/170,788, filed on Apr. 20, 2009.

(51) Int. Cl.
*F27D 17/00* (2006.01)

(52) U.S. Cl.
USPC ..... 432/179; 432/180; 165/4

(58) Field of Classification Search
USPC ..... 432/179, 180, 181; 165/4, 10
See application file for complete search history.

(56) References Cited

U.S. PATENT DOCUMENTS

| | | | | | |
|---|---|---|---|---|---|
| 3,870,474 | A * | 3/1975 | Houston | 422/171 |
| 5,259,757 | A * | 11/1993 | Plejdrup et al. | 432/181 |
| 5,620,668 | A * | 4/1997 | Driscoll et al. | 422/175 |
| 5,888,063 | A * | 3/1999 | Scott et al. | 432/181 |
| 5,891,411 | A * | 4/1999 | Gribbon | 423/245.3 |
| 7,017,592 | B2 * | 3/2006 | Chiles et al. | 134/22.1 |
| 7,507,084 | B2 * | 3/2009 | Chiles et al. | 431/3 |
| 2005/0260103 | A1 * | 11/2005 | Tesar et al. | 422/110 |

* cited by examiner

*Primary Examiner* — Gregory A Wilson
(74) *Attorney, Agent, or Firm* — Renner, Kenner, Greive, Bobak, Taylor & Weber

(57) ABSTRACT

A purge air control for a regenerative thermal oxidizer (RTO) having a plurality of exhaust towers containing a heat-exchange media includes a controller to determine an amount of clean air needed to purge the media. The controller opens a balancing damper to draw the determined amount of air into the RTO to purge the solvent-laden air from the heat-exchange media. As such, by determining the precise amount of air needed to purge the heat-exchange media, energy consumption associated with the purge process is reduced.

12 Claims, 4 Drawing Sheets

PURGE AIR CONTROL FOR A REGENERATIVE THERMAL OXIDIZER

CROSS-REFERENCE TO RELATED APPLICATION

This application claims the benefit of U.S. Provisional Application No. 61/170,788 filed Apr. 20, 2009, the specification of which is incorporated herein by reference.

TECHNICAL FIELD

The present invention is directed primarily to regenerative thermal oxidizers (RTO) used to treat solvent-laden air (SLA). In particular, the present invention is directed to regenerative thermal oxidizers that utilize a purge duct to remove stagnant solvent-laden air from the heat exchange media of the towers of a combustion chamber before each tower begins its outlet cycle. More particularly, the present invention is directed to regenerative thermal oxidizers that control the amount of cleaned, treated air used to purge the previously-used ceramic heat-exchange media based on its size, lower plenum volume of the towers, and air-flow rates in the purge duct, so as to reduce energy consumption.

BACKGROUND OF THE INVENTION

Regenerative thermal oxidation is used for the purification of solvent-laden exhaust gas that is generated as a byproduct of various processes, such as painting for example. Typically, to carry out the oxidation process, a regenerative thermal oxidizer (RTO) 10, such as the pull-through regenerative thermal oxidizer shown in FIG. 1, is used. The RTO 10 includes two or more regenerative chambers or towers; however, for the purposes of the following discussion, the RTO 10 is shown to have three towers 20A-C. Disposed within each tower 20A-C are respective heat-exchange elements or media 30 A-C, which are formed from ceramic or any other suitable material. In addition, each of the towers 20A-C maintains an upper plenum region 40A-C that is located in the tower 20 at a point above the media 30A-C and which are operatively coupled together via a combustion chamber 50. The combustion chamber 50 maintains one or more burners 60, which are typically fueled by natural gas, propane, or other suitable fuel, for heating and oxidizing organic compounds and other pollutants in the solvent-laden air being treated or abated by the RTO 10. Alternatively the combustion chamber 50 can be heated with electric coils. In one aspect, some combustion chambers 50 have a self-sustain mode where as long as the established LEL (lower explosive limit) is maintained, no additional heat source is required (i.e., the burner/coil is off) since oxidation will be sustained without it.

Air movement through each of the towers 20A-C and the combustion chamber 50 is controlled by valve groups 70A-C that are respectively maintained proximate a lower plenum region 80A-C of the towers 20A-C, whereby the lower plenum 80A-C located at the region below the media 30A-C and above the valve groups 70A-C. The valve groups 70A-C respectively includes a set of three valves, an inlet valve 90A-C, a purge valve 92A-C, and an exhaust valve 94A-C, which controls the flow of air through the heat-exchange media 30A-C that are respectively disposed within each of the towers 20A-C. As such, the inlet valves 90A-C are operatively coupled to an inlet manifold or duct 100, which receives solvent-laden air from a pollution source 102. The purge valves 92A-C are operatively coupled to a purge manifold or duct 110 that is coupled to an exhaust stack 120. Finally, the exhaust valves 94A-C are operatively coupled to an exhaust manifold or duct 130 that is operatively coupled to an electrically powered exhaust blower 140 that expels air that is oxidized and cleaned by the RTO 10 into the exhaust stack 120. Thus, the valves 90A-C, 92A-C, and 94A-C enable each of the towers 20A-C of the RTO 10 to switch function during changes in operating cycles in accordance with any one of three primary modes: an inlet mode; a purge mode and an exhaust mode.

For example, as shown in FIG. 1, during one operating cycle of the RTO 10, the inlet valve 90A of tower 20A is opened, exhaust valve 94B of tower 20B is opened, and purge valve 92C of tower 20C is opened, while the remaining valves 92-94A, 90-92B, and 90C and 94C are closed. As such, solvent-laden air is drawn through the inlet manifold 100 and through the inlet valve 90A before entering the heat-exchange media 30A provided by the tower 20A. After entering the heat-exchange media 30A, the solvent-laden air enters the combustion chamber 50, as well as the upper part of media 30A, where it is oxidized by the heat generated by the burner 60. The heated oxidized air, which is now cleaned, passes through the heat-exchange media 30B of tower 20B, where the heat of the air is transferred to the media 30B prior to being drawn into the exhaust manifold 130, where the air is evacuated from the exhaust stack 120 by the exhaust blower 140.

Somewhat simultaneously with the evacuation of the cleaned air from the exhaust stack 120, a portion of the clean air is drawn from the exhaust stack 120 and delivered to the tower 20C via the purge duct 110 where it passes through the purge valve 92C and the media 30C before being drawn into the cleaned airflow passing through the heat-exchange media 30B and out through the exhaust duct 130. Because the media 30C and the lower plenum have accumulated pollutants and contaminates from the intake of solvent-laden air during a previous inlet operating mode, the purging of the heat exchange media 30C and lower plenum with cleaned air from the exhaust stack 120 prevents those pollutants and solvent laden air from being output at the exhaust stack 120 when the tower 20C is operated in a subsequent exhaust mode.

As previously discussed, the RTO 10 is configured so each of the towers 20A-C operates primarily in either of an inlet, exhaust, or purge mode during various operating cycles. Therefore, when the operating cycle of the RTO 10 changes at timed intervals, the tower 20A, which is currently operating in an inlet mode, switches to a purge mode; tower 20B, which is currently operating in an exhaust mode, switches to an inlet mode; and tower 20C, which is currently operating in a purge mode, switches to an exhaust mode. Moreover, in a subsequent operating cycle, the tower 20A that is operating in a purge mode switches to an exhaust mode; tower 20B, which is operating in an inlet mode, switches to a purge mode; and tower 20C, which is operating in an exhaust mode, switches to an inlet mode. As such, by alternating the operating function of each of the towers 20A-C between an inlet mode, outlet mode, and purge mode during successive operating cycles, allows the heat maintained by the heated oxidized air that is passing through the heat exchange media 30A-C associated with the exhaust mode of the tower 20A-C to be utilized in a subsequent intake mode to preheat incoming solvent-laden air. As a result, the heat generated by the burner 60 that is used to oxidize a cleaned airflow passing out of the media 30A-C is then recaptured and used to pre-heat a subsequent incoming air flow of solvent-laden air, thereby reducing the amount and extent to which the burner 60 is required to operate, thus increasing combustion efficiency. In addition, the purge cycle that is performed subsequently after one of the towers 20A-C has operated in an inlet mode ensures that spikes or severe elevations in VOCs (volatile organic compounds) or other pollutants are kept to a minimum from the tower 20A-C, when being operated in an exhaust mode after allowing solvent-laden air to enter the tower during a previous inlet mode.

However, current RTO systems 10 rarely have control over the amount of purge air that is permitted to flow into the towers 20A-C during a purge cycle, other than the selection of the diameter of the ducting forming the purge manifold 110 and in some cases a rough setting to a purge balancing damper. As such, most existing RTO systems 10 supply an excessive amount of clean air to purge the entire cross-section of the heat exchange media 30A-C, while no existing RTO system focuses on optimizing purge flow in a way to optimize performance while minimizing cost.

Furthermore, because of the operation of the RTO 10, the upper portion of the media 30A-C that is adjacent to the upper plenum region 40A-C is heated by the combustion chamber 50 to flashpoint temperatures, resulting in the abatement of accumulated pollutants therein, while the lower portion of the media 30A-C that is adjacent the lower plenum region 80A-C does not reach flashpoint temperatures, and therefore the pollutants and solvent laden air (SLA) contained therein are not abated. However, while only a portion of the ceramic media 30A-C requires purging, current RTOs operate the exhaust blower 140 to generate an airflow that is in excess of that required (and on pull-through RTO systems without a separate purge fan). As such, the exhaust blower 140 is pulling a higher volume of air than is needed, and as a result increased electrical consumption and costs are incurred. In addition to the solvent-laden air being abated within the combustion chamber 50, cooled air from the exhaust stack 120 that is used to purge the media 30 being cleaned lowers the temperature of the combustion chamber 50 from set-point/flash-point temperatures that are needed to oxidize the solvent-laden air being abated by the RTO 10. And as such, the burner 60 is required to operate for an extended period of time to reach temperatures needed to oxidize solvent-laden air in the combustion chamber 50. Thus, it would be advantageous to provide enough air to purge only the lower portion of the media 30A-C at the region of the lower plenum 80A-C that has not reached flashpoint temperatures, so as to reduce the energy consumed by the exhaust blower 140 and the burner 60, thereby reducing the overall operating costs of the RTO 10, while also reducing greenhouse emissions associated with combustion.

Therefore, there is a need for a purge air control system for a regenerative thermal oxidizer that calculates the amount of purge air needed to purge the media of an RTO tower in order to maintain destructional efficiencies at high levels. In addition, there is a need for a purge air control system for a regenerative thermal oxidizer that utilizes reduced utilities in which to purge the heat exchange media of an RTO.

SUMMARY OF THE INVENTION

In light of the foregoing, it is a first aspect of the present invention to provide a thermal oxidizer comprising a regenerative thermal oxidizer having a heat-exchange media that is in fluid communication with a purge duct that is coupled between said media and an exhaust, a controller, and a balancing damper coupled to the purge duct to control the flow of air entering said purge duct from said exhaust, wherein said controller actuates said balancing damper to provide a predetermined volume of air to said purge duct to clean said heat-exchange media.

It is another aspect of the present invention to provide a method for purging heat-exchange media of a regenerative thermal oxidizer comprising providing a balancing damper in fluid communication with an exhaust stack that supplies air via a purge duct that is in fluid communication with heat-exchange media provided by the regenerative thermal oxidizer, coupling a controller to said balancing damper, obtaining the air volume within said heat-exchange media, obtaining the purge time of the regenerative thermal oxidizer, dividing the air volume of said media by the purge time to obtain a tuned purge flow rate, and adjusting said balancing damper to generate an airflow equal to said tuned purge flow rate to purge said heat-exchange media.

BRIEF DESCRIPTION OF THE DRAWINGS

These and other features and advantages of the present invention will become better understood with regard to the following description and accompanying drawings where.

BEST MODE FOR CARRYING OUT THE INVENTION

Figure 1:
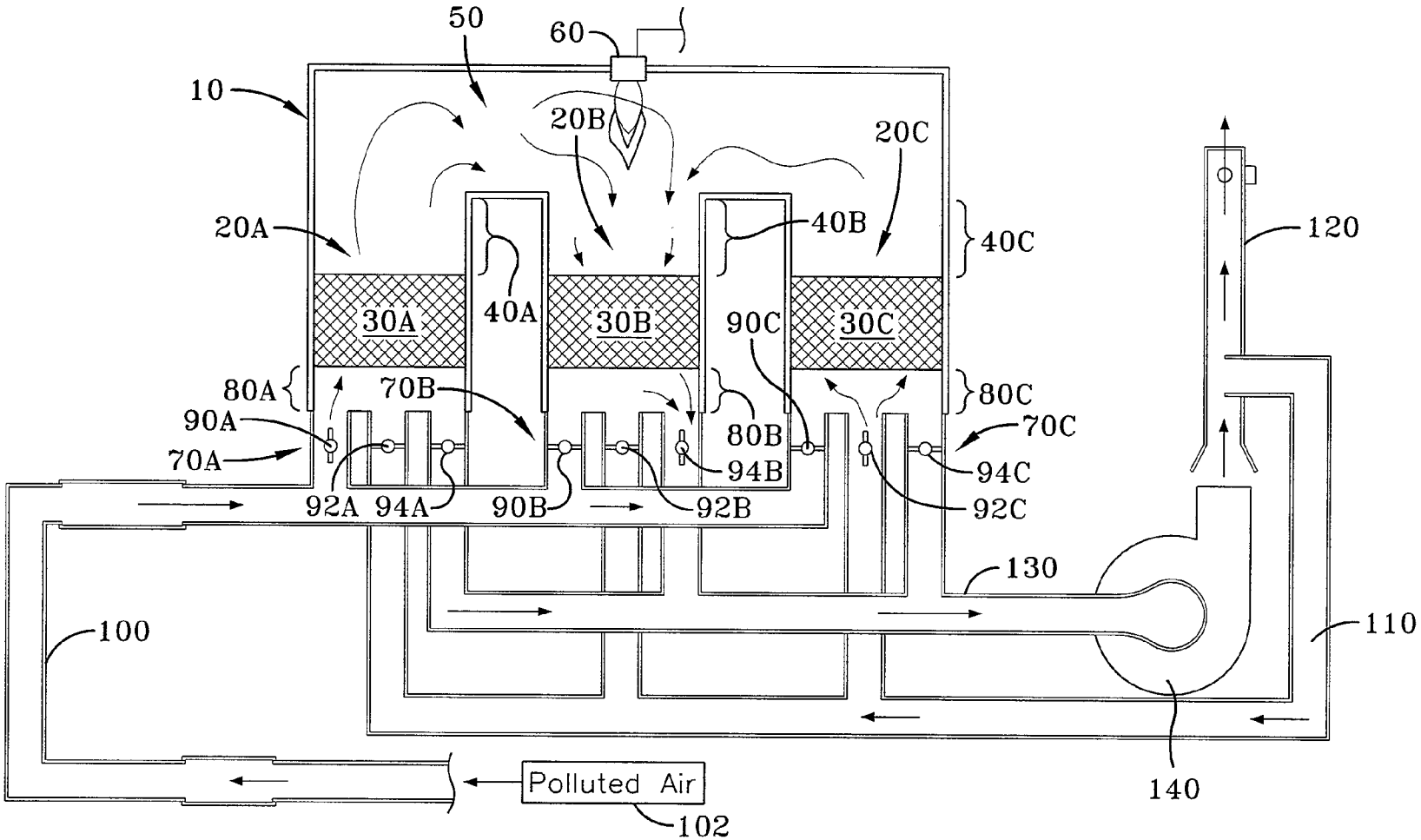
FIG-1 PRIOR ART
FIG. 1 is a block diagram of a prior art pull-through regenerative thermal oxidizer.
Figure 2:
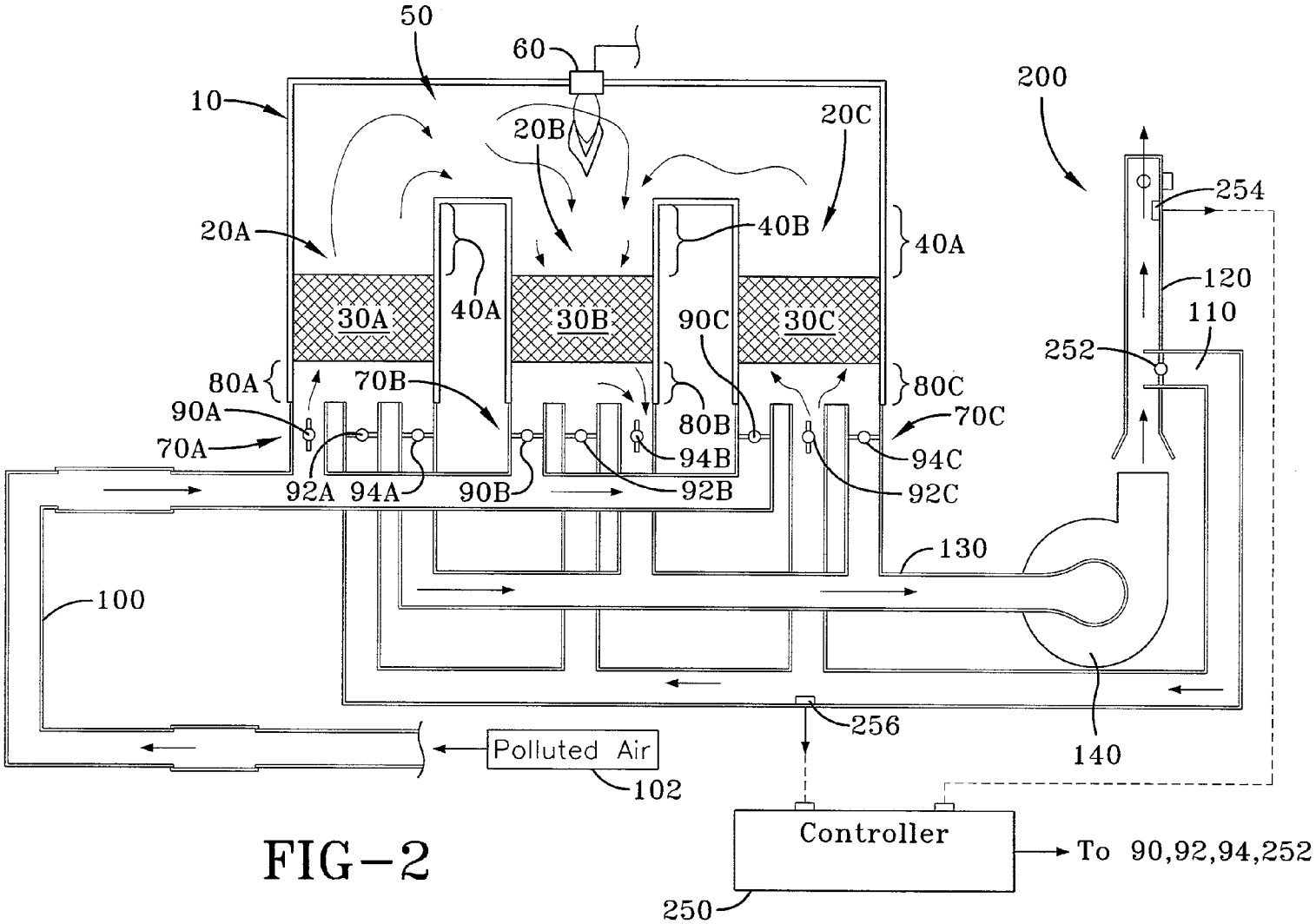
FIG. 2 is a block diagram of a pull-through regenerative thermal oxidizer utilizing a control system and a purge balancing damper in accordance with the concepts of the present invention.

A purge air control system for the pull-through regenerative thermal oxidizer 10 is generally referred to by the numeral 200, as shown in FIG. 2 of the drawings. The purge air control system 200 provides a controller 250 that is electrically (and/or through programming) coupled to the inlet, purge, and outlet valves 90-94A-C, and the exhaust blower 140. A purge balancing damper 252 is also coupled to the controller 250 and is disposed within the purge air duct 110 of the RTO 10 and is operated to control the amount of cleaned air exiting the exhaust stack 120 that is permitted to re-enter the RTO 10 during a purge cycle to be discussed in detail below. It should be appreciated that the purge balancing damper 252 can be located anywhere upstream of the first branch of the purge air duct 110 to the tower 20, and/or could be set up individually at each tower 20 purge location. The controller 250 may comprise any general purpose or application specific computing device, including a Programmable Logic Control (PLC) that is suitable for carrying out the functions to be discussed. The controller 250 may also have an input and/or output interface, such as a display and keyboard, to enable the operator to interact with the functions of the system 200 to be discussed. Specifically, the controller 250 identifies the amount of purge air volume that is needed to purge pollutants from the portion of the media 30 that is adjacent the lower plenum regions 80A-C of the towers 20A-C, and which does not reach flashpoint temperatures during operation of the RTO 10. In one aspect, the controller 250 may be programmed with the cross-sectional size of the ceramic media 30A-C that is needed to be purged. Next, based on the cross-sectional size of the ceramic media 30A-C, the controller 250 opens the purge balancing damper 252 to the extent needed to generate the needed volume of purge air to purge the lower portion of the previously-used ceramic media 30A-C. A VOC (volatile organic compound) sensor 254 coupled to the controller 250 and located within the exhaust stack 120 determines the magnitude of VOC spikes that are emitted from the previously purged ceramic media 30A-C. In addition, an airflow sensor 256 is also coupled to the controller 250 and is disposed within the purge airflow duct 110 to monitor the airflow rate therewithin so that the precise amount of purge air is used. In addition to determining the levels of VOCs being emitted from the ceramic media 30A-C, the controller 250 may also calculate the total discharge concentration that is being achieved by the RTO 10. Thus, in one aspect, the controller 250 adjusts the amount in which the purge balancing damper 252 is open, so that solvent-laden air is not emitted from the tower 20A-C when the tower 20A-C is initially placed in an outlet mode, while using reduced utility consumption. For example, utilizing this process, an RTO utilizing 13.5 mcf (thousand cubic feet) of natural gas to operate its burner per hour dropped to 11 mcf per hour. Thus, a reduction in total natural gas consumption of 18.5% was achieved by utilizing the system 200. As such, utility savings associated with the operation of the system 200 comes from less air being heated, as less fuel is consumed by the burner 60 to heat the combustion chamber 50 and the media 30.

The cooled air from the exhaust stack 120 that is used to purge the media 30 lowers the temperature of the combustion chamber 50 from set-point/flash-point temperatures needed to oxidize the solvent-laden air being abated by the RTO 10. Thus, because the system 200 reduces the amount of cooled purge air used by the RTO 10, the amount of air within the combustion chamber 50 (solvent-laden air and purge air) is also reduced, and as a result the amount of fuel or electricity needed to operate the burner 60 in order to reach set-point/flash-point temperatures is significantly reduced, thereby resulting in reduced RTO operating costs. Moreover, since the system 200 requires less purge air than is typically required, the exhaust blower 140 can operate at a reduced air moving capacity, such that the operating costs associated with the exhaust blower 140 are also reduced. This reduction can allow a facility to draw additional air volume from its sources, and/or add additional sources, to a system that was previously operating at maximum capacity.

Base-line data on the operational parameters of the RTO 10 should be available from the owner of the RTO 10. Within those base-line parameters should be information on destructional rate efficiencies (DRE) including pre-existing spikes in volatile organic compounds within the exhaust stack 120 as determined by engineering and EPA testing.

Figure 3:
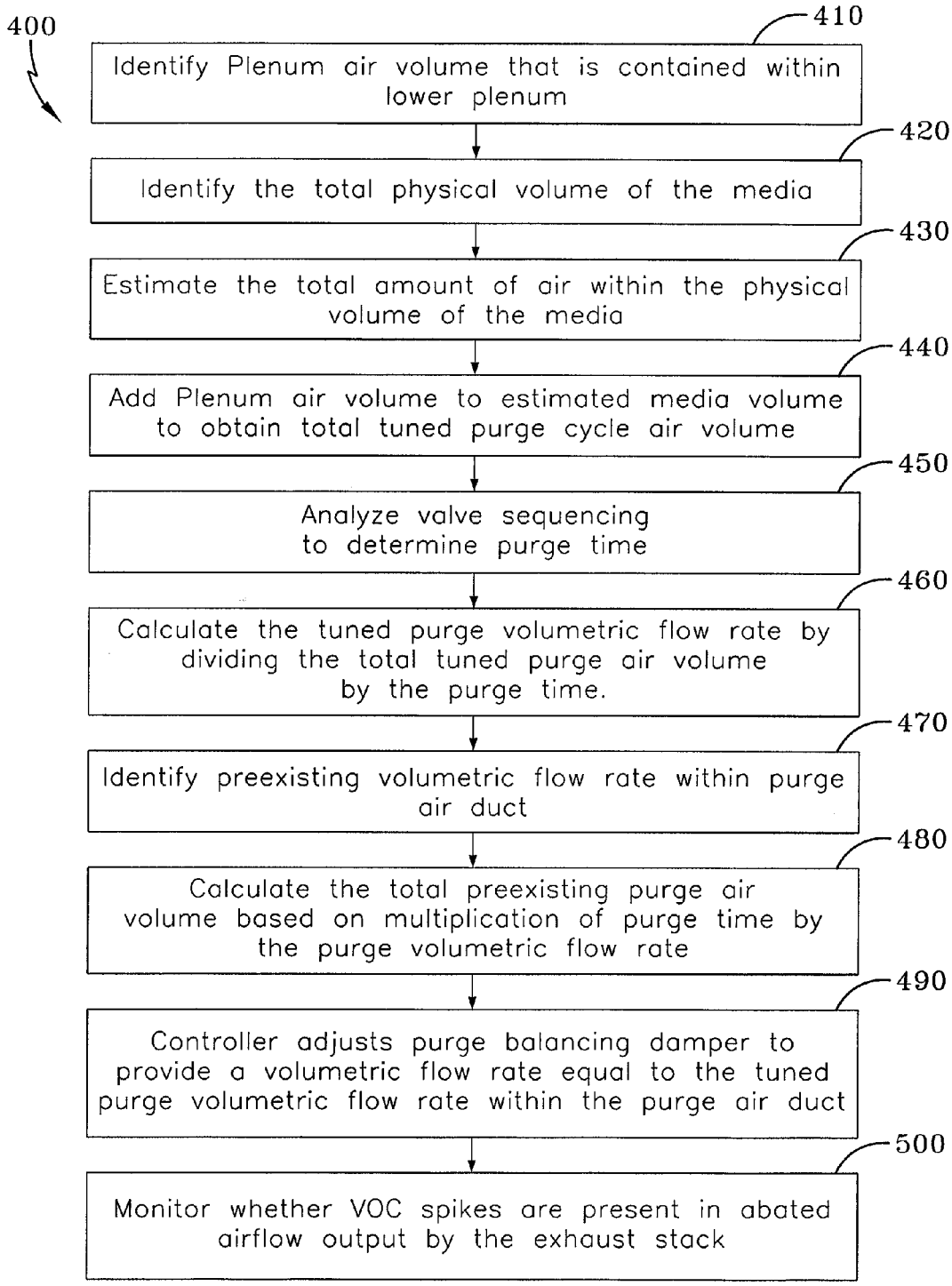
FIG. 3 is a flow diagram showing the operational steps taken to purge one or more of the ceramic heat exchange media in accordance with the concepts of the present invention.

With the structural components of the RTO 10 now set forth, the operational steps, generally referred to by the numeral 400 for carrying out the purge mode provided by the system 200 will now be presented, as shown in FIG. 3 of the drawings. It should be appreciated that the steps 400 may be carried out by any suitable computing device, such as controller 250. Initially, at step 410 the plenum air volume that is contained within the lower plenum region 80 of the tower 20A-C to be purged is identified or otherwise acquired by the controller 250. For example, the controller 250 may identify that the air volume of the lower plenum region 80 is 880 cubic feet. Next, at step 420 the total physical volume of the media 30 of the tower 20A-C being purged is identified or otherwise acquired by the controller 250. In one aspect, the controller 250 may ascertain that the total physical volume of the media 30 is 1,540 cubic feet for example. Continuing to step 430, the process 400 carried out by the controller 250 estimates the total amount of air within the physical volume of the media 30, herein referred to as the estimated media air volume, by taking a percentage of the total physical volume of the media 30. For example, the controller 250 may calculate the estimated media air volume as 50% of the 1540 cubic feet total physical volume of the media 30 or 770 cubic feet. However, depending on the density, and other parameters associated with the specific media 30 used in the RTO 10, the process 400 may estimate that about 50-75% of the total physical volume of the media 30 is comprised of air. However, it should be appreciated that other manners known in the art for identifying the air content of the physical volume of the media 30 may also be utilized.

Continuing to step 440, the process carried out by the controller 250, adds the plenum air volume to the estimated media air volume to obtain the total tuned purge cycle air volume, which is the total air volume that is needed to purge the media 30 and the lower plenum region 80 of the tower 20 being purged, which contains solvent-laden air. For example, the controller 250 adds the 880 cubic feet comprising the plenum air volume with the 770 cubic feet comprising the estimated media air volume to obtain 1,650 cubic feet that comprises the total purge cycle air volume. Next, at step 450 the controller 250 carrying out the process 400 determines or otherwise estimates that the sequencing of valves 90A-C, 92A-C, 94A-C to identify the elapsed time of each purge, which is referred to herein as the purge time. For example, the purge time may be estimated by the controller 250 to be 0.5 minutes. It should be appreciated that the timing of the purge cycle may be maintained within the programming of the existing RTO 10, such that the controller 250 will read or acquire that information (the time the purge cycle lasts will be a variable set by maintenance personnel) from the RTO 10 and alternately the controller 250 can change the valve sequencing timing for each RTO 10 operating cycle in order to further minimize redundancy. Additionally, if all controls are within a PLC (programmable logic control) or similar computerized automation system, a line in the programming of the new controller 250 will be instructed to go to line x and read the value, and dump that value into new programming. In the case in which the operating sequence 400 is implemented solely in hardware, the timing of the purge cycle may be read by a technician installing the system 200 and then entered into the controller 250 manually. After the valve sequencing is examined, the process continues to step 460, the total tuned purge air volume is divided by the purge time as determined at step 450 to obtain the tuned purge volumetric flow rate, which identifies the precise volumetric flow rate within the purge duct or manifold 110 to provide the correct air volume needed to pass into the RTO tower 20 to complete the purge cycle with minimal or no excess air. For example, the controller 250 may divide the tuned purge air volume of 1,650 cubic feet by the purge time of 0.5 minute to obtain the tuned purge volumetric flow rate of 3,300 cubic feet per minute (CFM). After the tuned purge volumetric flow rate is calculated, the process continues to step 470, where the controller 250 identifies the untuned or pre-existing purge volumetric flow rate within the purge air duct 110 via an airflow sensor 256 located therewithin For example, the controller 250 may determine that the pre-existing purge volumetric flow rate within the purge air duct 110 using real-time air flow monitoring, or real-time pressure readings. For example, the controller 250 may estimate that the pre-existing purge volumetric flow rate as 11,000 cubic feet per minute (CFM). Next, at step 480, the purge time is multiplied by the pre-existing purge volumetric flow rate to obtain the pre-existing total purge volume. For example, the controller 250 may obtain the total pre-existing purge air volume by multiplying 0.5 minutes, which comprises the purge time by 11,000 CFM, which comprises the pre-existing purge volumetric flow rate to obtain the total pre-existing purge air volume of 5,500 cubic feet (CF).

It should be appreciated that step 480 is used for two purposes. In particular, the first purpose of step 480 is to compare the pre-existing purge volume to the tuned purge volume in order to confirm that sufficient purging is taking place. If the tuned purge volume is less than the pre-existing purge volume, there is an excess volume being purged, which can be eliminated using the process 400. However, if the tuned purge volume is greater than the pre-existing purge volume, there is insufficient purging occurring, and as such, no purge tuning of the RTO 10 is possible, resulting in unacceptable VOC spikes at the exhaust stack 120. And the second purpose of step 480 is to quantify the exact decrease in flow resulting from the process 400. Before changing any variables, determining the pre-existing purge volume allows for calculating utility cost savings and flow reduction resulting from the installation of the process 400. Once tuning is complete, the tuned volumetric flow rates and the tuned purge volume will be used in comparison with the pre-existing purge volume to determine cost savings to the operator of the RTO 10. Likewise, a comparison between these two conditions of the purge volume allows the operator of the RTO 10 to identify any increase in capacity available for the addition of source flow and/or additional sources.

Continuing to step 490, the controller 250 adjusts the balancing damper 252 to allow a volumetric flow rate equal to the tuned volumetric flow rate calculated in step 460. Thus, by adjusting the balancing damper 252 via the controller 250, the 11,000 CFM total pre-existing purge volumetric flow rate is reduced to achieve the 3,300 CFM tuned purge volumetric flow rate. Finally, at step 500, the process monitors the volatile organic compound (VOC) sensor 254 to determine if an increase in VOC spikes (when compared with baseline data provided by the client) are occurring in the output of cleaned airflow that is exiting the RTO via the exhaust stack 120. In the event an increase in VOC spikes is identified, the process 400 returns to step 430, increasing the estimated air volume of the media, continuing through the entire process 400 until VOC spikes are at or below the baseline level.

In one aspect, it should be appreciated that DRE (destruction rate efficiency) is a quantity that is identified before the present invention 200 is implemented with the RTO 10. As such, the goal of existing purge systems is to remove VOC spikes, and improve DRE (i.e., no spikes=increased DRE, since fewer un-abated VOC's are being emitted). While, this goal is achieved inefficiently in prior art systems, the present invention 200 achieves this goal, (no spikes, with high DRE) with a significant reduction in utility consumption.

It should be appreciated that steps 410-500 may be performed using a combination of separate instruments, whereupon the values calculated are then input into the controller 250, or the steps 410-500 may be performed using suitable sensors interfaced with the RTO 10 and the controller 250 to allow for the control of the purge airflow as discussed. That is other instruments could be used whereby, instead of installing a suitable sensor to read the volumetric flow rate within the purge duct, the installer could use a portable air-flow sensor to read comparable data, and manually enter that data into the controller 250 as needed. Moreover, instead of installing a suitable sensor in the exhaust stack to determine the existence of VOC spikes within the exhaust stream, the installer could use a portable gas air monitor to read this value intermittently, and manually enter that value into the controller 250 as needed. This manual process can accomplish the same thing as the installed sensors and automated process as described herein, but with less flexibility and reliability. Similar methods can be applied to all steps within the process.

Moreover, it should also be appreciated that while RTO 10 discussed herein comprises a pull-through regenerative thermal oxidizer (RTO), the control system 200 along with the control process 400 may be readily adapted for use with other types of RTOs, including push-through type, and push-through or pull-through rotary-type RTOs. Also, some RTOs may utilize a separate purge fan—this fan may safely be removed in conjunction with installation of the present invention, further reducing utility consumptions via a reduction of electric consumption and reduction of cool air to be heated.

It should also be appreciated that the process 400 can be utilized with various other pollution abatement processes that require purging in order to achieve optimal OR higher efficiency performance.

It should also be appreciated that if during the ongoing operation of the RTO 10 the VOC sensor 254 detects a substantial change in VOC spikes in the exhaust stack 120, the controller 250 provides an audible and/or visual prompt to alert facility personnel. Such a spike could indicate an operational problem with the VOC sensor 254 or with some other aspect of the RTO 10.

Figure 4:
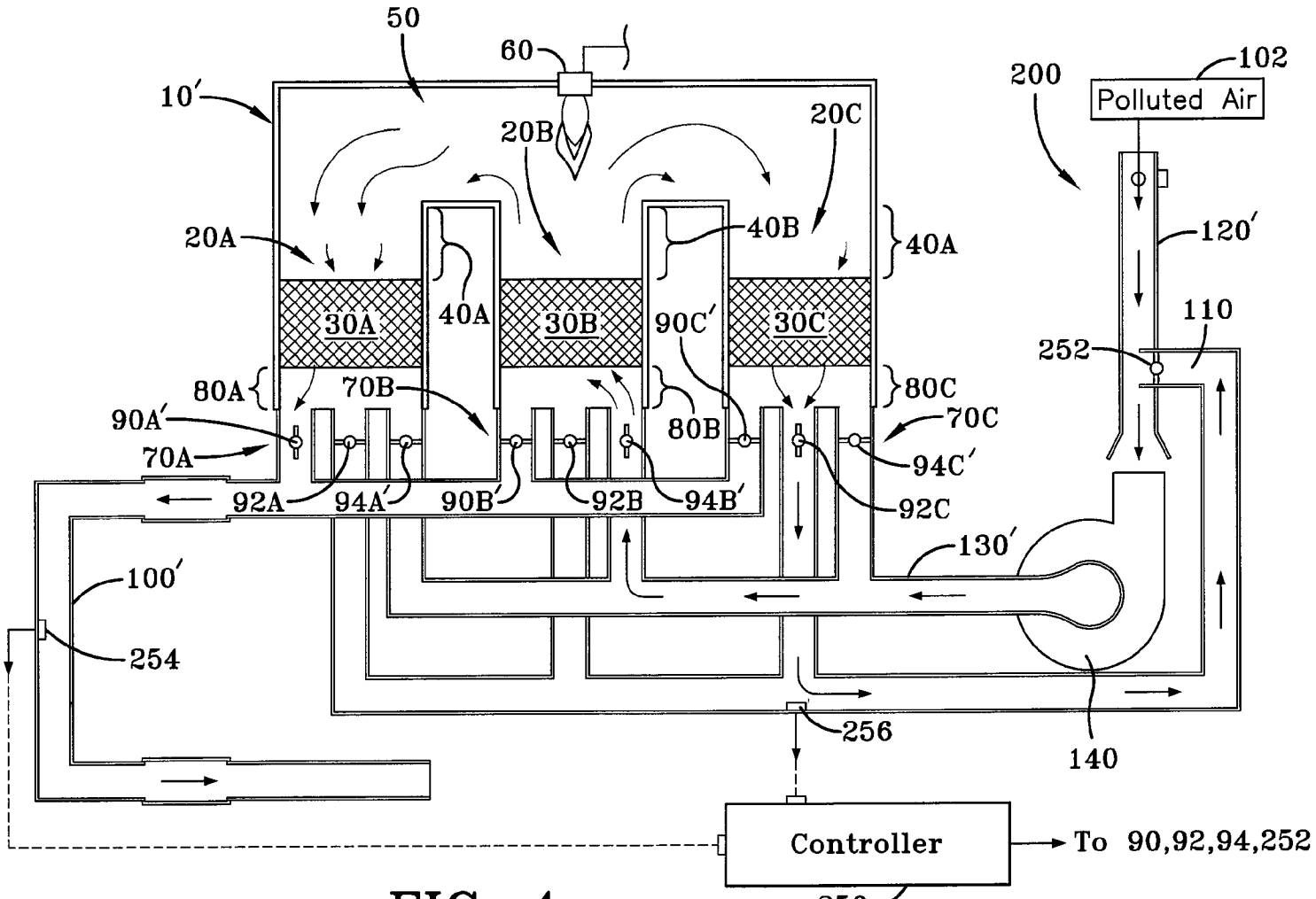
FIG. 4 is a block diagram of a push-through regenerative thermal oxidizer utilizing a control system and a purge balancing damper in accordance with the concepts of the present invention.

It should be appreciated that while the purge air control system 200 discussed above relates to a pull-through regenerative thermal oxidizer 10, the system 200 can be readily adapted for use with a push-through regenerative thermal oxidizer, denoted by reference numeral 10', as shown in FIG. 4. Furthermore, the essential operation of the pull-through regenerative thermal oxidizer (RTO) 10 is equivalent to the that of the push-through regenerative thermal oxidizer (RTO) 10', with the exception that the inlet duct 100, the exhaust stack 120, the exhaust manifold 130, and the associated inlet valves 90A-C and exhaust valve exhaust valves 94A-C, of the pull-through regenerative thermal oxidizer (RTO) 10 are swapped or otherwise operated in a reversed manner, in the push-through RTO 10'. That is, the inlet duct 100 of the pull-through RTO 10 becomes the exhaust duct 100' of the push-through RTO 10', and the exhaust stack 120 and the exhaust manifold 130 of the pull-through RTO 10 now respectively becomes the inlet duct 120' and the inlet manifold 130' in the push-through RTO 10'. In addition, the inlet valves 90A-C and the exhaust valves 94A-C of the pull-through RTO 10 respectively become the exhaust valves 90A-C' and the inlet valves 94A-C' in the push-through RTO 10'.

It should also be appreciated that the purge duct 110 of the push-through RTO 10', is fluidly coupled at one end to the inlet duct 120', where the balancing damper 252, under control of the controller 250 provided by the system 200, controls the flow or amount of purge air from the purge duct 110 that enters into the blower 140 and into inlet manifold 130'. Furthermore, because the other end of the purge duct 110 is still coupled to the purge valves 92A-C, the purge duct 110 and the purge valves 92A-C retains the same function in the push-through RTO 10' as described in the pull-through RTO 10. Furthermore, the VOC sensor 254 of the push-through RTO 10' is also positioned in the exhaust duct 100' in a similar manner to that of the pull-through RTO 10. Thus, instead of pulling air through the RTO as in the pull-through RTO 10, the push-through RTO 10' pushes air through the RTO. Finally, FIG. 4 shows an operational state of the push-through RTO 10' in which tower 20B is on an inlet cycle, tower 20A is on an outlet cycle, and tower 20C is on a purge cycle.

Therefore, one advantage of the present invention is that the combustion burner(s) are only required to heat the precise air volume required to purge the unflashed portion of the heat-exchange media of the RTO so as to save energy. Another advantage of the present invention is that reduced electrical and fuel utilities are consumed while eliminating or significantly reducing spikes of VOCs and/or other pollutants. In addition the present invention maintains proper purge operation during various fan speeds. Another advantage of the present invention is the increase in available airflow for the abatement of additional solvent laden air (SLA) on an RTO previously operating at maximum capacity. And yet, another advantage is the possible removal of redundant purge fan/flushing fan and subsequent utility savings.

Although the present invention has been described in considerable detail with reference to certain embodiments, other embodiments are possible. Therefore, the spirit and scope of the appended claims should not be limited to the description of the embodiments contained therein.

What is claimed is:

1. A thermal oxidizer comprising:

a regenerative thermal oxidizer having a heat-exchange media that is in fluid communication with a purge duct that is coupled between said media and an exhaust;

a controller; and a balancing damper coupled to said purge duct to control the flow of air entering said purge duct from said exhaust;

wherein said controller actuates said balancing damper to provide a predetermined volume of air to said purge duct to clean said heat-exchange media, such that said predetermined volume of air is computed by said controller based on the purge airflow rate within said purge duct.

2. A thermal oxidizer comprising:

a regenerative thermal oxidizer having a heat-exchange media that is in fluid communication with a purge duct that is coupled between said media and an exhaust;

a controller;

a balancing damper coupled to said purge duct to control the flow of air entering said purge duct from said exhaust; and a sensor coupled to said controller to monitor the level of volatile organic compounds (VOC) in the air output by said exhaust;

wherein said controller actuates said balancing damper to provide a predetermined volume of air to said purge duct to clean said heat-exchange media.

3. A method for purging heat-exchange media of a regenerative thermal oxidizer comprising:

providing a balancing damper in fluid communication with an exhaust stack that supplies air via a purge duct that is in fluid communication with heat-exchange media provided by the regenerative thermal oxidizer;

coupling a controller to said balancing damper;

obtaining the air volume within said heat-exchange media;

obtaining the purge time of the regenerative thermal oxidizer;

dividing the air volume of said media by the purge time to obtain a tuned purge flow rate; and adjusting said balancing damper to generate an airflow equal to said tuned purge flow rate to purge said heat-exchange media.

4. The method of claim 3, further comprising:

providing a sensor in said exhaust stack;

coupling said sensor to said controller; and monitoring volatile organic compound (VOC) output at said exhaust stack.

5. A thermal oxidizer comprising:

a regenerative thermal oxidizer having a heat-exchange media that is in fluid communication with a purge duct that is coupled between said media and an inlet duct;

a controller; and a balancing damper coupled to said purge duct to control the flow of air entering said inlet duct from said purge duct;

wherein said controller actuates said balancing damper to provide a predetermined volume of air to said inlet duct to clean said heat-exchange media, such that said predetermined volume of air is computed by said controller based on the purge airflow rate within said purge duct.

6. A thermal oxidizer comprising:

a regenerative thermal oxidizer having a heat-exchange media that is in fluid communication with a purge duct that is coupled between said media and an inlet duct;

a controller;

a balancing damper coupled to said purge duct to control the flow of air entering said inlet duct from said purge duct; and a sensor coupled to said controller to monitor the level of volatile organic compounds (VOC) in the air output by an exhaust duct in fluid communication with said regenerative thermal oxidiser;

wherein said controller actuates said balancing damper to provide a predetermined volume of air to said inlet duct to clean said heat-exchange media.

7. A method for purging heat-exchange media of a regenerative thermal oxidizer comprising:

providing a balancing damper in fluid communication with an inlet duct that supplies air from a purge duct that is in fluid communication with heat-exchange media provided by the regenerative thermal oxidizer;

coupling a controller to said balancing damper;

obtaining the air volume within said heat-exchange media;

obtaining the purge time of the regenerative thermal oxidizer;

dividing the air volume of said media by the purge time to obtain a tuned purge flow rate; and adjusting said balancing damper to generate an airflow equal to said tuned purge flow rate to purge said heat-exchange media.

8. The method of claim 7, further comprising:

providing a sensor in an exhaust stack in fluid communication with the regenerative thermal oxidizer;

coupling said sensor to said controller; and monitoring volatile organic compound (VOC) output at said exhaust stack.

9. A thermal oxidizer comprising:

a regenerative thermal oxidizer having a heat-exchange media that is in fluid communication with a purge duct that is coupled between said media and an exhaust;

a controller; and a balancing damper coupled to said purge duct to control the flow of air entering said purge duct from said exhaust;

wherein said controller is pre-programmed with an air volume amount, such that said controller actuates said balancing damper to provide said air volume amount to said purge duct to clean said heat-exchange media.

10. A thermal oxidizer comprising:

a regenerative thermal oxidizer having a heat-exchange media that is in fluid communication with a purge duct that is coupled between said media and an exhaust;

a controller;

a balancing damper coupled to said purge duct to control the flow of air entering said purge duct from said exhaust; and a sensor coupled to said controller to monitor the level of volatile organic compounds (VOC) in the air output by said exhaust;

wherein said controller actuates said balancing damper to provide a predetermined volume of air to said purge duct based on the level of volatile organic compounds (VOC) detected by said sensor to clean said heat-exchange media.

11. A thermal oxidizer comprising:

a regenerative thermal oxidizer having a heat-exchange media that is in fluid communication with a purge duct that is coupled between said media and an inlet duct;

a controller; and a balancing damper coupled to said purge duct to control the flow of air entering said inlet duct from said purge duct;

wherein said controller is pre-programmed with an air volume amount, such that said controller actuates said balancing damper to provide said air volume amount to said purge duct to clean said heat-exchange media.

12. A thermal oxidizer comprising:

a regenerative thermal oxidizer having a heat-exchange media that is in fluid communication with a purge duct that is coupled between said media and an inlet duct;

a controller;

a balancing damper coupled to said purge duct to control the flow of air entering said inlet duct from said purge duct; and a sensor coupled to said controller to monitor the level of volatile organic compounds (VOC) in the air output by an exhaust duct in fluid communication with said regenerative thermal oxidizer;

wherein said controller actuates said balancing damper to provide a predetermined volume of air to said purge duct based on the level of volatile organic compounds (VOC) detected by said sensor to clean said heat-exchange media.

* * * * *